United States Patent [19]

Sonneville

[11] Patent Number: 4,773,591

[45] Date of Patent: Sep. 27, 1988

[54] ELASTIC RAIL PAD

[75] Inventor: Roger P. Sonneville, Annapolis, Md.

[73] Assignee: Sonneville International Corporation, Washington, D.C.

[21] Appl. No.: 909,956

[22] Filed: Sep. 22, 1986

[51] Int. Cl.[4] ..... E01B 9/30

[52] U.S. Cl. ..... 238/283; 238/307; 238/265

[58] Field of Search ..... 238/283, 265, 264, 304, 238/306, 307

[56] References Cited

U.S. PATENT DOCUMENTS

| | | | |
|---|---|---|---|
| 635,500 | 10/1897 | Miller | 238/307 |
| 3,081,035 | 3/1963 | Meyer | 238/283 |
| 3,565,336 | 2/1971 | Eisses | 238/265 |
| 4,239,156 | 12/1980 | Skinner | 238/283 X |
| 4,618,093 | 10/1986 | Young et al. | 238/283 |
| 4,648,554 | 3/1987 | McQueen | 238/283 |

FOREIGN PATENT DOCUMENTS

| | | | |
|---|---|---|---|
| 526472 | 8/1954 | Belgium | 238/283 |
| 1380302 | 10/1964 | France | 238/283 |
| 3512200 | 10/1986 | Fed. Rep. of Germany | 238/283 |
| 323496 | 2/1972 | U.S.S.R. | 238/283 |
| 942258 | 11/1963 | United Kingdom | 238/283 |

*Primary Examiner*—Kenneth J. Dorner
*Assistant Examiner*—Laurie K. Cranmer
*Attorney, Agent, or Firm*—Wenderoth, Lind & Ponack

[57] ABSTRACT

An elastic rail pad to be positioned between a tie and a rail includes a first portion to be positioned beneath a foot of the rail at the field side thereof, a second portion to be positioned beneath the rail foot at the gauge side thereof, and a connecting portion connecting the first and second portions and having a dimension in a direction parallel to the longitudinal dimension of the rail less than dimensions of the first and second portions in such direction. The first, second and connecting portions of the pad are in the form of a single, integral member formed of a relatively stiff elastomeric material having the properties of high resistance to wear and tangential shear forces, high elastic memory and elastic stability over a wide range of varying temperatures.

13 Claims, 1 Drawing Sheet

ELASTIC RAIL PAD

BACKGROUND OF THE INVENTION

The present invention relates to an elastic rail pad to be positioned between a rail and a tie of a railroad track to dampen vibrations, protect the ties from dynamic impact loading, and to reduce rail wear and rolling stock maintenance costs.

The use of such elastic rail pads is known, and conventionally such elastic rail pads are formed of a flexible elastomer material such as natural rubber. Such material however does not have sufficient resistance against wear and rips caused by compression and repeated tangential forces exerted by passing rail wheels.

Furthermore, it is known to employ synthetic elastomer materials such as ethylene vinyl acetate (E.V.A.) which provide improved resistance against such forces. However, such known material does not have good elastic stability at a wide range of different temperatures, but rather has a wide variety of elastic moduli with temperature change. Such material becomes too flexible and soft at temperatures above 50° C., and at low temperatures common in North America such materials become hard and even fragile.

Furthermore, such known elastic rail pads conventionally have employed a substantially rectangular or trapezoidal shape. As a result, pressure from a passing train and rail concentrates substantially at the center of the elastic pad. This concentrated load exerts maximum pressure on the underlying tie at a point substantially along the longitudinal axis of the rail. Since the tie may be regarded as a beam bearing on an elastic support, i.e. the underlying ballast, the tie is subjected to a maximum bending moment, with resultant stresses thereon.

SUMMARY OF THE INVENTION

With the above discussion in mind, it is an object of the present invention to provide an improved elastic rail pad having the properties of high resistance to wear and tangential shear forces, high elastic memory and improved elastic stability over a wide range of temperatures.

It is a further object of the present invention to provide such an elastic rail pad having a unique configuration resulting in an improved distribution of forces from the rail to the tie and thereby the avoidance of concentrated forces on the tie and reduced bending moment stresses thereon.

It is a still further object of the present invention to provide an elastic rail pad having such improved characteristics and at a reduced cost, or at least a cost competitive with known elastic rail pads.

These and other objects of the present invention are achieved in accordance with the present invention by the provision of an elastic rail pad to be positioned between a tie and a rail and including a first portion to be positioned beneath the foot of the rail at the field side thereof, a second portion to be positioned beneath the rail foot at the gauge side thereof, and a connecting portion connecting the first and second portions and having a dimension in a direction parallel to the longitudinal dimension of the rail less than dimensions of the first and second portions in such direction. The first, second and connection portions of the pad are in the form of a single, integral member formed of a relatively stiff elastomeric material having the properties of high resistance to wear and tangential shear forces, high elastic memory and elastic stability at a wide range of different temperatures.

Certain recently developed synthetic elastomers, such as "polyester rubber" or polyether-amide copolymers, are much less sensitive to temperature changes and offer excellent resistance to wear and tangential shearing forces. Such materials also have high elastic memory. However, these elastomers are relatively hard and stiff. As employed herein, the term "relatively stiff" refers to a material having a Shore D hardness of approximately 40 to 50. It is contemplated that the elastic raid pad of the present invention be formed of such materials. With such relatively hard or stiff properties however, it is necessary to reduce the relative area of the pad to augment deflection thereof to increase compressibility and to absorb shocks and vibrations transmitted by the rail to the tie.

Thus, in accordance with the present invention, the elastic rail pad is provided with a unique configuration which increases the pressure per unit area transmitted by the rail to the tie under a given load. Specifically, the elastic rail pad has a shape such that the majority of the area of the pad is aligned along the opposite longitudinal edges of the rail. This avoids concentration of vertical forces acting along the center line of the rail on the tie, thereby reducing bending moment stresses on the tie.

Furthermore, the elastic rail pad of the invention has such construction with a reduced overall horizontal area, thereby reducing the material weight and thereby cost of the pad, while at the same time increasing the pressure per unit area thereof, as discussed above.

In accordance with a further feature of the present invention, since the resultant of vertical and lateral forces exerted by a wheel on a rail always is transmitted to a larger extent to the field side of the track, the portion of the rail pad positioned at the field side of the rail has a greater area than the portion of the rail pad positioned at the gauge side of the rail. As a result, the same force per unit area is exerted on the pad over its entire area. This avoids compression of one part of the pad more than other parts, thereby further avoiding premature wear and permanent deformation of the pad, and corresponding widening of the track gauge.

In further accordance with the present invention, to additionally increase compressibility and the ability to absorb shocks and vibrations transmitted by the rail, the elastic rail pad of the present invention is formed of the above materials, but additionally of a microcellular structure, i.e. to have a reduced density.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
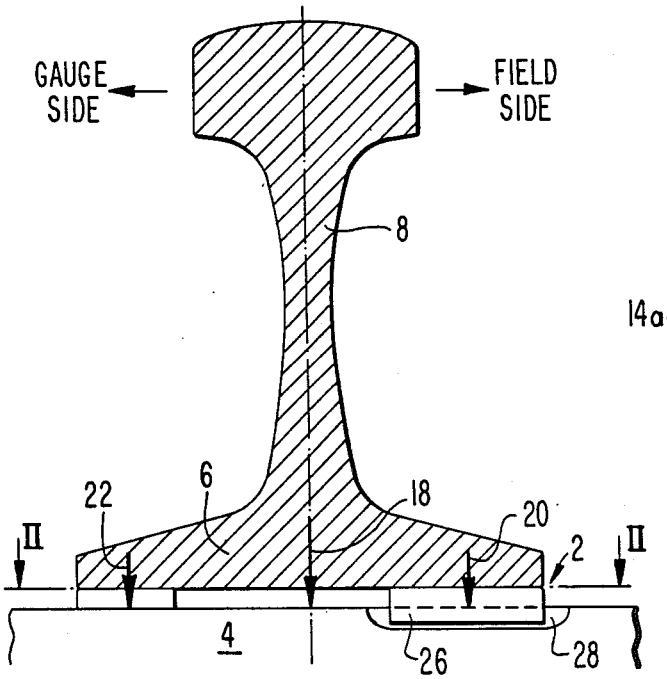
FIG. 1 is a transverse section through a rail positioned above a tie having positioned therebetween an elastic rail pad of the present invention, shown in elevation.
Figure 2:
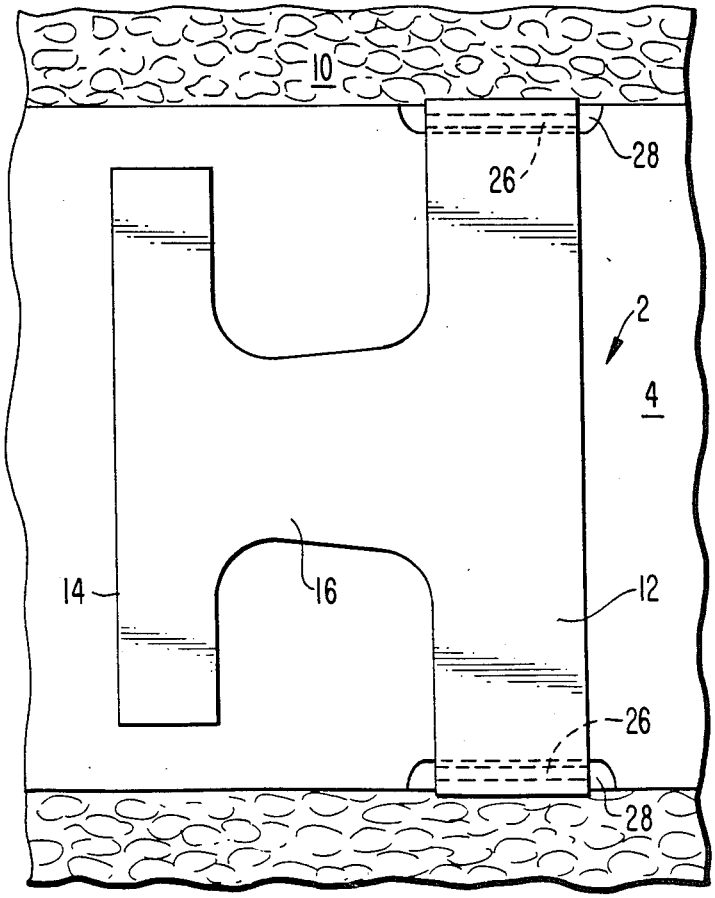
FIG. 2 is a plan view of the elastic rail pad of FIG. 1, shown along line II—II of FIG. 1.

With reference now to FIGS. 1 and 2 of the drawings, there is shown an elastic rail pad 2 according to one embodiment of the present invention and shown positioned between a tie 4, for example of known concrete type, and the foot 6 of a rail 8. Tie 4 is supported on track ballast 10 in a known manner.

As shown particularly in FIG. 2, the elastic rail pad 2 of the present invention has, as viewed from above, a substantially H-shaped configuration including a first portion 12, approximately in the shape of an elongated strip, extending in the longitudinal direction of the rail and positioned beneath foot 6 of rail 8 at the field side thereof, i.e. at the side directed away from the other rail of the track. Pad 2 includes a second portion 14, in the form of a strip elongated in the longitudinal direction of the rail, positioned beneath rail foot 6 at the gauge side of the rail, i.e. at the side of the rail directed toward the other rail of the track. The pad 2 further includes a connecting portion 16 connecting first portion 12 and second portion 14 and having a dimension in a direction parallel to the longitudinal dimension of the rail less than dimensions of first portion 12 and second portion 14 in such direction. In other words, connection portion 16 has a substantially reduced dimension, compared with portions 12, 14, in the longitudinal direction of the rail, i.e. vertically as shown in FIG. 2. The importance of this relative dimensional relationship will be apparent from a consideration of FIG. 1. Thus, if the elastic rail pad were of a generally rectangular configuration when viewed from above, then the vertical forces exerted downwardly on tie 4 would be concentrated substantially along the vertical center line of rail 8, as indicated by arrow 18 in FIG. 1. This would result in a concentrated load creating a maximum downward bending moment to tie 4. On the other hand, in accordance with the feature of the present invention, wherein connecting portion 16 is of substantially reduced dimension, the downward vertical forces exerted on the tie are concentrated along central areas of first portion 12 and second portion 14, as indicated by arrows 20, 22 in FIG. 1. It will be readily apparent therefore that the downward forces are more evenly distributed in accordance with the present invention, with the result that the tie 4 will be subjected to substantially reduced bending moments.

FIG. 2 illustrates a further important feature of the present invention. Thus, on railroad tracks, the vertical and lateral forces exerted by a wheel on a rail are transmitted substantially to the field side of the track. A conventional rectangular rail pad therefore is compressed much more to the field side thereof than to the gauge side. In accordance with the present invention however, first portion 12 has a greater area than second portion 14, and this is done for a given track to provide that the rail pad is equally compresed over the entire area. As shown in FIG. 2, the area of portion 12 is greater than the area of second portion 14, such that the force per unit area over the entire pad is equal. Specifically, FIG. 2 illustrates first portion 12 as having a greater dimension in a direction transverse to the longitudinal dimension of the rail than second portion 14. First portion 12 also is shown with a greater dimension in the longitudinal dimension of the rail than the second portion 14. It will be understood by those skilled in the art that the specific relative dimensions would be varied depending upon conventional operating factors such as degree of curve of the track, weight of trains moving thereover, speed of such trains, etc., the intent being that the force per unit area over the entire horizontal area of the pad being equal, without concentrated forces being applied thereto.

Figure 3:
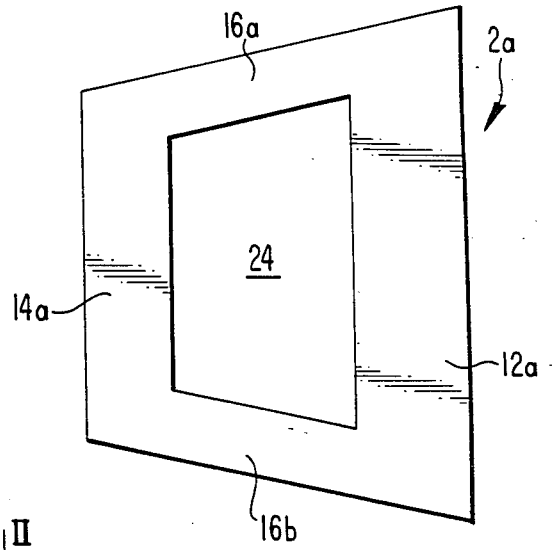
FIG. 3 is a plan view of one alternate shape of the elastic rail pad according to the invention.

The horizontal shape of the pad however need not be the H-shape shown in FIG. 2, but may be various other shapes as will be apparent to those skilled in the art, as long as the above functions are achieved, i.e. a reduced central dimension, and a greater area of the field side of the pad than on the gauge side thereof. FIG. 3 illustrates one possible such alternate shape, wherein pad **2*a* has a first portion 12*a* to be located along the field side of the rail and a second portion 14*a* to be located along the gauge side of the rail. First portion 12*a* has a greater area than second portion 14*a*. Portions 12*a*, 14*a* are connected by a connecting portion including first part 16*a* connecting adjacent first ends of portions 12*a*, 14*a* and a second part 16*b* connecting adjacent second ends of the first portion 12*a* and second portion 14*a*. The overall dimension of the connecting portion including parts 16*a*, 16*b* has a dimension in a direction parallel to the longitudinal dimension of the rail less than the dimensions of first and second portions 12*a*, 14*a* in such direction, and parts 16*a*, 16*b* are separated by an opening 24** through the center of the pad.

The elastic rail pad of the present invention is formed of a relatively stiff elastomeric material having the properties of high resistance to wear and tangential shear forces, high elastic memory and elastic stability at a wide range of temperatures.

It particularly is contemplated that the material of the pad of the invention be elastically stable over a temperature range of at least −20° F. to +140° F., and particularly preferably over a temperature range of −40° F. to +160° F. Furthermore, it is contemplated that the material have a Shore D hardness of approximately 40 to 50. Suitable materials are "polyester rubber" or polyether-amide copolymers. One such suitable material is an elastomeric polyester manufactured by Dupont under the trademark Hytrel. It is believed that those skilled in the art would understand what other materials might be employed in accordance with the present invention to achieve the above results and objects of the invention.

It particularly is desirable if such material has a microcellular structure, i.e. is manufactured incorporating a foaming agent, to be of reduced density and improved compressibility. It particularly is contemplated that such materials might have a specific gravity of as low as 0.8 and might include 5 to 30 volume percent gas or voids. Again however, These values are intended to be illustrative only and not limiting to the scope of the present invention, the purpose here being that the material has increased compressibility and relatively reduced price, while at the same time having the properties of high resistance to wear and tangential shear forces, high elastic memory and elastic stability at a wide range of varying temperatures.

FIGS. 1 and 2 illustrate a further feature of the present invention which is advantageous. Thus, the pad may include integral projections 26 extending downwardly at positions spaced in the longitudinal dimension of the rail. Such projections 26 may be embedded in grooves 28 molded in the tie 4 to facilitate proper placement of the pad in both the transverse and longitudinal directions. Projections 26 fitting in grooves 4 also will aid in preventing pad slippage or movement during use. In the particularly illustrated arrangement, projections 26 extend downwardly from opposite ends of first portion 12.

Although the present invention has been described and illustrated with respect to preferred features thereof, it is to be understood that various modifications and changes may be made to the specifically illustrated features without departing from the scope of the present invention.

I claim:

1. An elastic rail pad to be positioned between a tie and a rail, said pad comprising:

a first portion means for positioning beneath a rail foot at the field side thereof;

a second portion means for positioning beneath the rail foot at the gauge side thereof;

at least one connecting portion connecting said first and second portion means and having a dimension in a direction parallel to the longitudinal dimension of the rail less than dimensions of said first and second portion means in said direction;

said first and second portion means and connecting portion comprising a single, integral member formed of a relatively stiff elastomeric material having the properties of high resistance to wear and tangential shear forces, high elastic memory and elastic stability at different temperatures; and the dimension of said first portion means transverse to the longitudinal direction of the rail being greater than the dimension of said second portion means transverse to the longitudinal direction of the rail, and the dimension of said first portion means in the longitudinal direction of the rail being greater than the dimension of said second portion means in the longitudinal direction of the rail, whereby the area of said first portion means is greater than the area of said second portion means.

2. A pad as claimed in claim 1, wherein said material is elastically stable over a temperature range of at least −20° F. to +140° F.

3. A pad as claimed in claim 2, wherein said material is elastically stable over a temperature range of from −40° F. to +160° F.

4. A pad as claimed in claim 1, wherein said material has a Shore D hardness of approximately 40 to 50.

5. A pad as claimed in claim 1, wherein said material comprises a "polyester rubber" or polyether-amide copolymer.

6. A pad as claimed in claim 5, wherein said material has a microcellular structure.

7. A pad as claimed in claim 6, wherein the specific gravity of said material is as low as 0.8.

8. A pad as claimed in claim 6, wherein said material comprises 5 to 30 volume percent of gas or voids.

9. A pad as claimed in claim 1, wherein said member has substantially an H-shaped configuration, and said connecting portion extends between said first and second portion means at a position approximately midway of the dimensions thereof in the longitudinal direction of the rail.

10. A pad as claimed in claim 1, wherein said connecting portion extends between at least adjacent first ends of said first and second portion means.

11. A pad as claimed in claim 10, wherein said connecting portion includes a first part extending between said adjacent first ends of said first and second portion means and a second part extending between adjacent second ends of said first and second portion means, and said first and second parts are separated by an opening through said member.

12. A pad as claimed in claim 1, further comprising integral projections extending downwardly from said member at positions spaced in the longitudinal dimension of the rail.

13. A pad as claimed in claim 12, wherein said projections extend downwardly from opposite ends of said first portion means.

* * * * *